United States Patent [19]

Cestari et al.

[11] Patent Number: 4,486,091

[45] Date of Patent: Dec. 4, 1984

[54] ELECTROPHOTOGRAPHIC COPIER

[75] Inventors: Bruno Cestari, Collegno; Riccardo Forlani, Turin; Piero Gontero, Cascina Martinetto-Bollengo, all of Italy

[73] Assignee: Ing. C. Olivetti & C., S.p.A., Ivrea, Italy

[21] Appl. No.: 516,810

[22] Filed: Jul. 25, 1983

Related U.S. Application Data

[62] Division of Ser. No. 350,240, Feb. 19, 1982.

[30] Foreign Application Priority Data

Feb. 24, 1981 [IT] Italy ..... 67250 A/81

[51] Int. Cl.[3] ..... G03G 15/00

[52] U.S. Cl. ..... 355/3 TR; 355/14 TR

[58] Field of Search ..... 355/3 TR, 14 TR, 3 DD, 355/14 D; 118/651, 656

[56] References Cited

U.S. PATENT DOCUMENTS

| | | | |
|---|---|---|---|
| 3,219,014 | 11/1965 | Mott et al. | 118/658 X |
| 4,195,927 | 4/1980 | Fotland et al. | 355/3 TR X |
| 4,274,361 | 6/1981 | Sanders et al. | 355/3 TR X |
| 4,348,098 | 9/1982 | Koizumi | 355/3 TR |
| 4,368,971 | 1/1983 | Watanabe et al. | 355/3 DD |
| 4,377,332 | 3/1983 | Tamura | 355/3 DD |
| 4,382,673 | 5/1983 | Nakajima et al. | 355/3 TR |

FOREIGN PATENT DOCUMENTS 3014848 11/1980 Fed. Rep. of Germany .

*Primary Examiner*—A. C. Prescott

*Attorney, Agent, or Firm*—W. R. Hulbert

[57] ABSTRACT

The photocopier uses a development process employing a magnetic brush formed on a rotating sleeve (102) of non-magnetic material in which a system of permanent magnets (108) rotates. The outer surface of the sleeve is subjected to a sandblasting process after grinding in order to create a very uniform finely roughened surface in order to make the thickness of the toner layer forming the magnetic brush constant. The photocopier also employs a toner fixing system operating cold and under pressure by means of a pair of rollers (56, 58) of different diameter rotating at the same angular speed in order to create slippage of the upper roller relative to the lower roller for the purpose of obtaining perfectly flat copies. The copier also contains a single circuit board (80) for the low voltage and high voltage supply.

5 Claims, 12 Drawing Figures

ELECTROPHOTOGRAPHIC COPIER

This is a division of application Ser. No. 350,240 filed Feb. 19, 1982.

BACKGROUND OF THE INVENTION

This invention relates to an electrophotographic copier of the type using a development process for the image to be reproduced which employs a magnetic brush. The copier preferably operates with a mono-component toner, and a system for fixing the toner to the copying sheet by means of pressure rollers under cold conditions.

Copiers of the described type are known, in which the magnetic brush is provided with a sleeve of non-magnetic material, on the outer surface of which there slides a layer of toner. Generally, the outer surface is finished mechanically by means of a grinding operation. This operation inevitably produces small helical grooves over the entire outer surface of the sleeve due to the feed of the grinding wheel. These grooves tend to convey the toner towards one end of the magnetic brush, with consequence irregularity in the development of the image to be reproduced.

Copiers are also known in which the toner is fixed to the paper under pressure by means of a pair of rollers pressed one against the other which have their axes inclined at a small angle to each other in order to compensate for the axial deformation due to the applied load.

The inclination of the axes leads to deformation of the copying sheets by twisting.

SUMMARY OF THE INVENTION

The object of the invention is to provide a copier which obviates the aforesaid drawbacks.

It is another object of the invention to provide a copier comprising a developing magnetic brush surrounded by a shell of a roughened external surface, in which the toner particles overlay the external surface of the shell with a uniform layer to perform copies of good quality.

It is a further object of the invention to provide a copier with a pair of fixing rollers skewed therebetween and arranged to nullify the deformations of the copy sheets caused by the inclination of the rollers' axes.

Other characteristics of the invention will appear clear from the following description and as set forth in the appended claims.

BIEF DESCRIPTION OF THE DRAWINGS

The invention will be described in more detail, by way of example, with reference to the accompanying drawings, in which.

Figure 5:
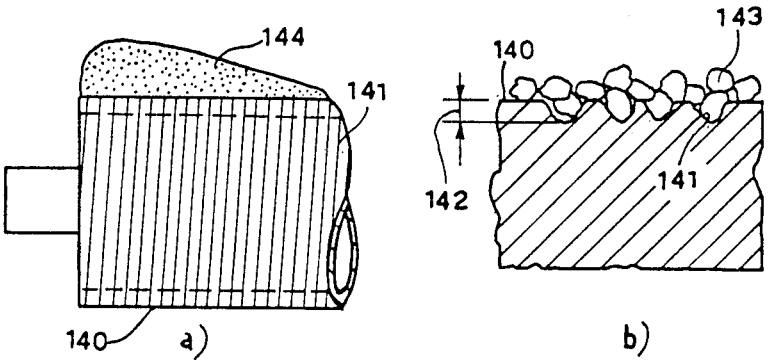

FIG. 5*a* is a partial view of a sleeve of a magnetic brush of known type;

FIG. 5*b* is an enlarged detail of FIG. 5*a;*

Figure 6A:
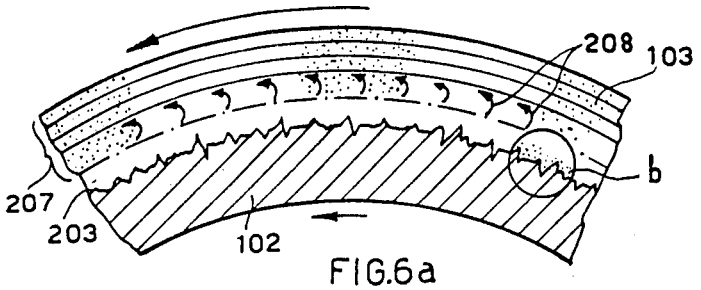
Figure 6B:
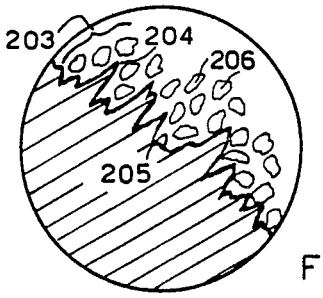

FIG. 6*a* is a partial section through the magnetic brush according to the invention;

FIG. 6*b* is an enlarged detail of FIG. 6*a;*

Figure 2:
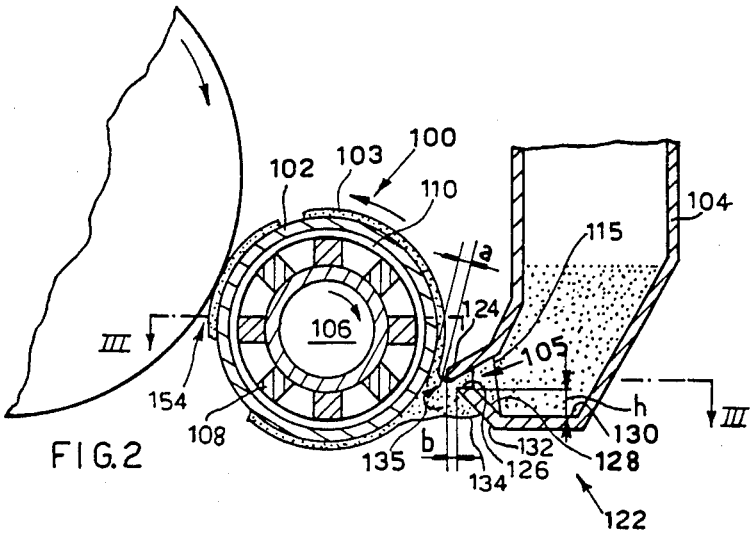
FIG. 2 is a section through the magnetic brush of the copier of FIG. 1.
Figure 7:
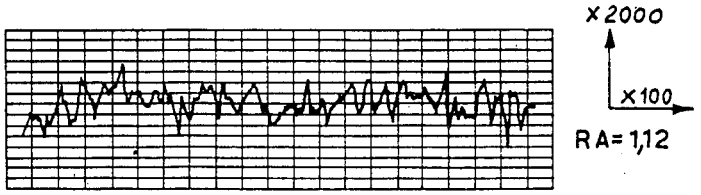
Figure 8:
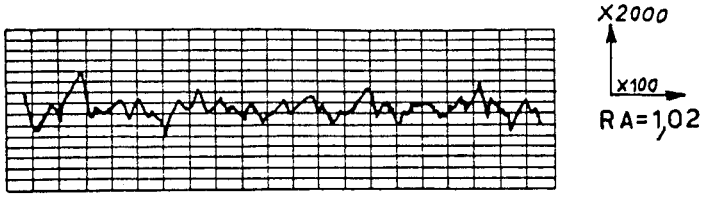

FIGS. 7 and 8 are roughness diagrams for the sleeve of FIGS. 2 and 6*a;*

Figure 1:
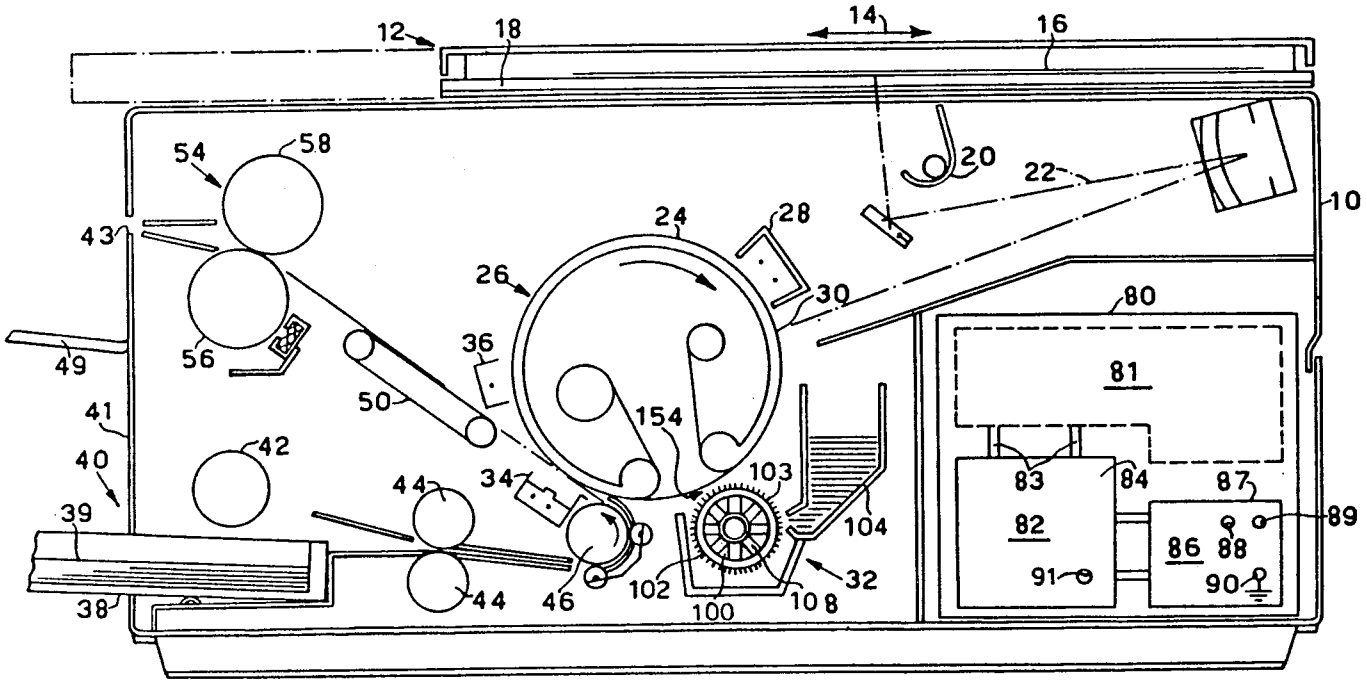
FIG. 1 is a diagrammatic section through a copier embodying the invention.
Figure 9:
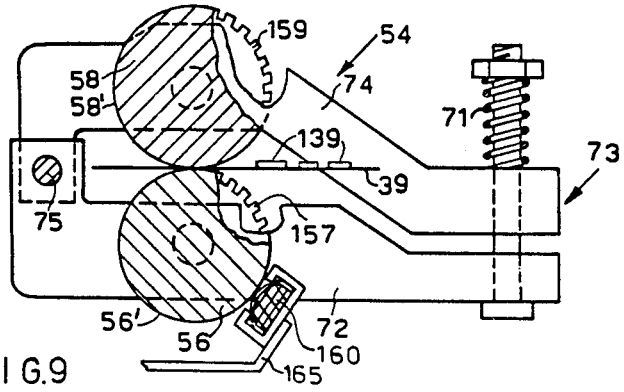
Figure 10:
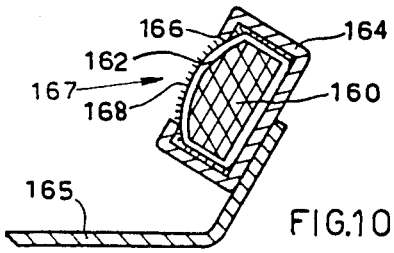

FIG. 9 is a cross-section through the fixing rollers of FIG. 1;

FIG. 10 shows the lubrication device for the rollers of FIG. 9 to an enlarged scale.

DETAILED DESCRIPTION OF THE PREFERRED EMBODIMENT

In FIG. 1 a carriage 12 is mounted on the top of copier casing 10 and can move in the two directions 14, to convey an original 16 disposed on a transparent plate 18 fixed to the carriage 12. The original 16 is illuminated by a lamp 20 in order to reflect the image to be reproduced along an optical path 22 on to a photoconductor 24 wrapped round a rotatable drum 26. The drum 26 rotates in a clockwise direction in order to move the photoconductor 24 successively into an electrostatic charge station 28 fed by a negative voltage of the order of −7000 V, into an exposure zone 30, into a development zone 32, into a transfer station 34 fed by a negative voltage of about −7300 V, and into an erasure station 36 fed by an alternating voltage of about 3500 Vac. During a second revolution of the drum 26, the residual toner remaining on the photoconductor 24 is removed in the station 32.

A drawer 38 containing copying sheets 39 is removably fitted into an aperture 40 situated in the left hand side 41 of the copier. The sheets 39 are fed one at a time by a sheet feeding roller 42 which feeds them by way of rollers 44, 46 to the transfer station 34. The sheets 39 are then conveyed by a belt conveyor 50 to a cold fixing station 54 constituted by two pressure rollers 56, 58. The sheets are fed from the fixing station 54 through an aperture 43 to a tray 49 fixed to the left hand side 41 of the copying machine.

Figure 3:
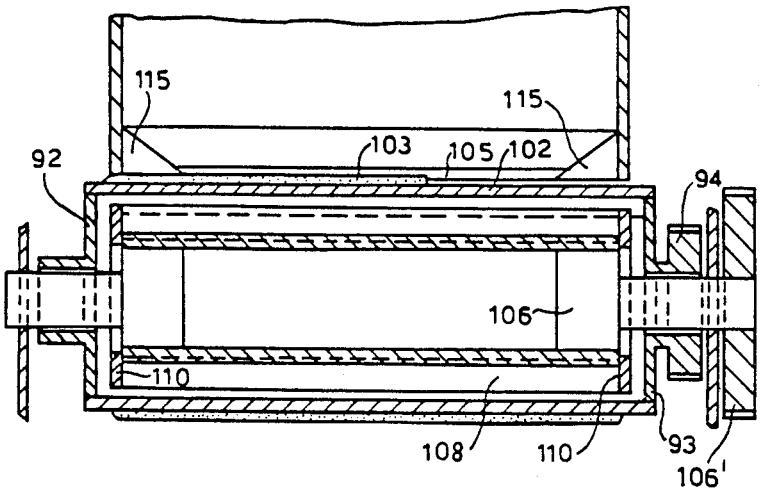
FIG. 3 is a section on the line III—III of FIG. 2.

The development station 32 comprises a magnetic brush 100 (FIGS. 2, 3) formed from a rotatable sleeve 102 of non-magnetic material such as stainless steel, on which there is formed a uniform layer 103 of toner fed by a hopper 104 through a slot 105. Inside the sleeve 102 there can rotate a steel shaft 106 on which permanent magnets 108 are fixed so that they extend axially and project radially from the shaft 106 nearly to the inside surface of the sleeve 102. The shaft 106 is rotated in a clockwise direction in FIGS. 1 and 2 by means of a gear wheel 106' (FIG. 3). The sleeve 102 is connected at its ends to flanges 92, 93 rotatable on the shaft 106. The flange 93 is also connected to a gear wheel 94 which rotates in an anticlockwise direction in FIGS. 1 and 2, such that the peripheral speed of the sleeve 102 lies between about 600 and 750 mm/sec.

Under the effect of the rotation of the magnetic field of the magnets 108, the toner becomes disposed on the sleeve 102 in the form of a layer 103 of uniform thickness, and slides on the sleeve in an anticlockwise direction with a peripheral speed greater than that of the sleeve 102, namely about 800 mm/sec. The toner layer 103 grazes the photoconductor 24 in the zone 154 of minimum distance between the sleeve 102 and drum 26, in order to develop in the normal manner the latent image formed on the photoconductor 24.

Figure 4:
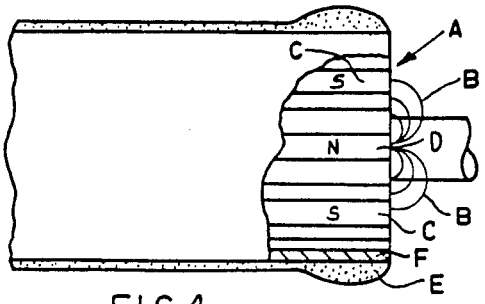
FIG. 4 is a partial view of a magnetic brush of known type.

In the known magnetic brushes (FIG. 4), at each of their ends 1 there is a concentration of lines of dispersed flux B, which become completed through the air between the ends C, D of adjacent magnets of opposite pole. These lines of flux lead to a concentration E of toner at the end of the sleeve F in the form of a ring of toner of greater thickness than the layer in the central part of the sleeve. These thicker lateral rings of toner cause a greater quantity of toner to be brought into contact with the photoconductor, which toner is no longer removed during the cleaning phase, thus damaging the photoconductor.

To overcome this drawback, according to one aspect of the invention a ring 110 of ferromagnetic material, for example soft iron, is fixed to the end of the magnets 108 (FIG. 3) in order to channel the end lines of flux into its interior. The ring 110 has an outer diameter equal to the outer diameter of the magnets 108 and a radial width not less than the height of the magnets 108.

At the same time, the useful length of the slot 105 in the hopper 104 is reduced by means of two limiting wedges 115 fixed to the side walls 116, 117 of the hopper 104. In this manner, the toner can no longer flow on to the lateral portions 119 of the sleeve 102 directly from the hopper, but is drawn there from the central zone 120, so that the thickness of the toner on the end portions is kept at a value not exceeding the thickness in the central zone. This is attained by choosing a useful length of the slot 105 which is from 80% to 92% of the length of the sleeve 102.

According to a further aspect of the invention, the hopper 104 (FIG. 2) is formed with a lower funnel-shaped part 122 bent towards the magnetic brush 100. The lower part 122 terminates in an upper edge 134 facing a lower edge 126 defining the slot 105, which extends along the entire magnetic brush 100. The lower edge 126 is formed by a stepping portion 128 of a base wall 130 of the hopper 104, with a lip which lies above the base 130 by a height h of between 4 and 7 mm. The slot 105 has a width of about 1 mm. The upper edge 124 is disposed at a distance a from the sleeve 102 of between 0.40 and 0.50 mm, and preferably 0.45 mm, while the lower edge 126 is set back from the upper edge by a distance b of about 1 mm.

Because of the high sliding speed of the layer of toner 103 on the sleeve 102 relative to the peripheral speed of the sleeve, an accumulation 134 of toner forms against the outer face 132 of the stapped portion 128, and moves with rotary motion in the direction of the arrow 135. When the toner consumption is low or zero, the accumulation of toner 134 increases until it assumes the relative dimensions of FIG. 3, to press against the slot 105 and prevent the exit of further toner. When however the toner consumption is high, the accumulation of toner 134 reduces until it grazes the lower edge 126, thus enabling toner to emerge from the slot 105.

In this manner, automatic control of the toner feed to the magnetic brush 100 is obtained as a function of the quantity of toner deposited on the photoconductor 24 during the development stage. This control is optimized by the assumption of a high peripheral speed of the toner layer 103 in combination with the aforesaid dimensions of the slot 105 of the hopper 104.

According to a further aspect of the invention, one drawback manifested by known magnetic brushes which have their sleeve externally ground is overcome. The grinding operation inevitably leaves on the outer surface of the sleeve 140 (FIG. 5*a*) small helical grooves 141 with a groove depth 142 (FIG. 5*b*) of the same order to magnitude as the size of the toner particles 143, which then deposit in the grooves and are conveyed towards one end of the sleeve to cause an accumulation of toner 144 thereat.

In order to favour the formation of a toner layer 103 of the most uniform possible thickness over the entire length of the sleeve 102, and to prevent the formation of lumps, according to a further characteristic of the invention the outer surface of the sleeve 102 is subjected to a sandblasting process in order to make it finely roughened by means of a sense texture of proturberances 204 (FIG. 6) and depressions 205 distributed uniformly in a random manner over the entire outer surface of the sleeve 102. As shown diagrammatically in FIGS. 6*a* and *b*, a first layer 203 of toner adheres to the sleeve 102 because the individual particles of toner 206 (FIG. 6*b*) penetrate into the depressions 205 and are entrained by the sleeve 102. In the layers 207 which lie above the layer 203, vortex movements 208 are created by friction due to the different peripheral speeds of the individual layers, to lead to a continuous mixing of the toner within the toner layer 103, so preventing the formation of lumps and favouring the uniform distribution of the toner over the sleeve 102. In particular, as the distribution of the protuberances 204 and depressions 205 over the outer surface of the sleeve 102 is entirely random, no axial friction force components are generated, and the only friction forces which move the toner particles inside the layer 103 are in a plane perpendicular to the axis of rotation of the sleeve, so that the toner particles moved by the vortex movements 208 do not translate axially but instead move only along circles perpendicular to the axis of rotation of the sleeve 102.

According to the present invention, the sleeve 102 is firstly ground until a surface roughness RA of between 0.1 and 1 μm is obtained. This is then followed by sandblasting with corundum powder having a particle size of between the standard values 60 and 400. The roughness RA obtained after the sandblasting lies between 0.3 and 2 μm RA.

FIG. 7 shows a diagram of the roughness determined in the axial direction on a sample of sleeve 102 treated by the aforesaid procedure, using corundum powder having a particle size of 200. FIG. 8 shows a similar diagram determined perpendicular to the axis of rotation of the sleeve 102.

The fixing rollers 56, 58 (FIG. 9) are rotatable on two pairs of levers 72, 74 respectively, of which only one pair is shown in the Figure, and are pressed together by spring means 71 acting on one end 73 of the levers 72, 74, which are hinged at their other end on a pin 75. The springs 71 apply to the levers 72, 74 a load which is so determined that the pressure exerted by the upper rollers 58 on the lower 56 is sufficient to fix a toner image deposited on the copying sheet 39 when the copying sheet is made to pass between the two rollers. The rollers 56, 58 are rotated in opposite directions at the same angular speed by means of a pair of equal gear wheels 157, 159.

The lower roller 56 is of hardened steel and has a specularly polished rolling surface 56', the upper roller 58 also being of hardened steel but having its surface 58' sandblasted and chromium plated by a procedure known in the art in order to provide copies having a non-reflecting opaque surface.

The two rollers 56, 58 are also so mounted that their axes form a small contained angle of between 30' and 2° in order to compensate for axial deformation due to the high applied load, and to allow uniform distribution of the load along the contact line.

In order to prevent the copying sheet from leaving in a deformed condition due to the inclination of the two rollers, according to a further characteristic of the invention the upper roller 58 is constructed with a diameter slightly greater than the diameter of the lower roller so as to create a limited peripheral slippage of the upper roller 58 relative to the lower roller 56. In this manner, the upper fibres of the sheet 39 are stretched to an equal extent over the entire width of the sheet, so that any twist caused by the inclination of the rollers is nullified.

The peripheral slippage S is defined by the equation:

$$S=\Delta\phi/\phi_i$$

where $\Delta\phi$ is the difference between the diameters of the two rollers and $\phi_i$ is the diameter of the lower roller 56. Optimum values of S lie between 0.001 and 0.003. The best flatness of the sheets is obtained when S=0.0013, and with normal paper having a substance of between 60 and 80 g/m$^2$.

According to a further characteristic of the invention, the lower roller 56 (FIGS. 9, 10) is lubricated with a small quantity of silicone oil, which is transferred by contact to the upper roller 58 during their rotation, during these stages which precede the arrival of a copying sheet to be fixed. The purpose of lubricating the fixing roller 58 is, as is known, to prevent adhesion between it and the toner particles, which would soil the copying sheets during their fixing during the subsequent revolutions of the roller 58.

The roller 56 is lubricated by means of a strip of felt 160 (FIG. 10) on which is wound a heavy fabric 162, for example a pile fabric provided on one face with a dense layer of fibres 168 such as velvet, so as to form a substantially cylindrical element 160, 162 removably inserted into an appropriate seat 164 supported by a cross member 165 and having a slot 166 facing the roller 56 over its entire length. The portion 167 of velvet fabric 162 included in the slot 166 extends outwardly such that its hairs 168 touch the roller 56.

The felt 160 is soaked with a predetermined quantity of silicone oil, which is then transferred to the roller 56 by capillarity through the fabric 162 by means of the fibres 168 of the velve 162. The quantity of oil transferred from the lubricating element 160 to the roller 56 can be varied by choosing different lengths of hairs 168. From tests carried out, it has been found that by varying the pile length from about 3 mm to about 6 mm, a corresponding average oil consumption is obtained which varies from about 4 g to about 7 g for every 10,000 copies made.

Because of the uniform distribution of the velvet pile fibres, the oil is transferred to the cylinder 56 in a constant manner over the entire length of the roller without any precise positioning of the element 160 relative to the roller 56 being required. In addition, by using a pile fabric of the velve type rather than other lubricating elements formed either from felt alone or from felt enclosed in a non-pile fabric, there is no oil accumulation at the contact strip between the element 160 and roller 56 during the non-working periods of the machine.

The machine is supplied electrically by means of a power unit disposed on a single printed circuit board 80 (FIG. 1) comprising all the supply circuits of the voltages required for the copier operation. More specifically, the board 80 is disposed vertically, and comprises a stabilized low voltage D.C. supply circuit 81 of known type, and not described in detail. The board 80 also comprises the high voltage generating circuits used in the charge station 28, transfer station 34 and erasure station 36. A step-up transformer 80 with a step-up ratio of 1:100 is fed with an alternating voltage of the order of 24 Vac taken from the power unit 81 at two tracks 83. The transformer 82 is embedded in a block 84 of epoxy resin of the type suitable for high voltage and having a dielectric constant of not less than 15,000 V/mm, and a specific electrical volume resistivity of the order of $1.10^{14}$ ohm. cm. The transformer 82 is of the known type, and is suitable for the high voltages concerned.

Two tracks 85, suitably spaced apart to prevent high voltage discharge, emerge from the transformer 82 to supply a voltage quadrupler circuit 86 of known type formed from a network of diodes and capacitors and embedded in an epoxy resin block 87 of the same type as stated heretofore. The high voltages required by the copier are available at two terminals 88, 89 fixed directly to the resin block 87, a third terminal 90 representing the earth of the high voltage power unit. An alternating voltage of about 3,500 Vac for supplying the erasure station 36 taken from a terminal 91 directly fixed to the block 84.

Modifications, additions or part substitutions can be made to the copier heretofore described without leaving the scope of the present invention as claimed hereinafter. For example, according to a further embodiment, the magnetic brush 100 (FIGS. 2 and 3) can contain within the sleeve 102 a single cylindrical permanent magnet suitably polarised in such a manner as to obtain on its cylindrical surface a succession of north poles regularly alternating with a like number of south poles.

What we claim is:

1. Electrophotographic copier comprising means for developing a latent image of an original to be reproduced and formed on a photoconductor element, means for transferring the developed image on to a sheet of paper, and a pair of opposing rollers for the cold-fixing of the image transferred on to said sheet, by the action of the pressure between the rollers, said rollers having their axes inclined to each other and at least one roller having a rough surface, wherein said one roller with the rough surface has a peripheral speed greater than the opposing roller of the pair, so that any deformation of the sheet caused by the inclination of the rollers is nullified.

2. Copier as claimed in claim 1, wherein said rollers rotate at the same angular speed in opposite directions and said rough roller has a greater diameter than the opposing roller.

3. Copier as claimed in claim 1, wherein the rough roller slips on the opposing roller with a slippage ratio of between 0.001 and 0.003.

4. Copier as claimed in claim 1, wherein said opposing roller is lubricated with silicone oil by means of a lubricating element formed from a sprongy member enclosed within a fabric provided with pile fibres on its outer face, so that the oil is transferred by contact, to the rough roller in order to prevent toner particles adhering to the surface thereof.

5. Copier as claimed in claim 4, wherein said fabric is a velvet having a layer of pile fibres of length from 1 to 10 mm.

* * * * *